US008016384B2

(12) United States Patent
Saito

(10) Patent No.: US 8,016,384 B2
(45) Date of Patent: Sep. 13, 2011

(54) IMAGE FORMING APPARATUS

(75) Inventor: Akira Saito, Kakuda (JP)

(73) Assignee: Ricoh Company, Ltd., Tokyo (JP)

( * ) Notice: Subject to any disclaimer, the term of this patent is extended or adjusted under 35 U.S.C. 154(b) by 381 days.

(21) Appl. No.: 12/392,466

(22) Filed: Feb. 25, 2009

(65) Prior Publication Data

US 2009/0225130 A1 Sep. 10, 2009

(30) Foreign Application Priority Data

Mar. 5, 2008 (JP) ..... 2008-054602

(51) Int. Cl.
*B41J 2/15* (2006.01)

(52) U.S. Cl. ..... 347/40; 347/49

(58) Field of Classification Search ..... 347/40, 347/43, 49, 64, 65
See application file for complete search history.

(56) References Cited

U.S. PATENT DOCUMENTS

| | | | | |
|---|---|---|---|---|
| 6,984,020 | B2 * | 1/2006 | Shinada et al. | 347/49 |
| 7,275,808 | B2 * | 10/2007 | Katsuyama et al. | 347/49 |
| 7,275,809 | B2 * | 10/2007 | Uwagaki et al. | 347/49 |

FOREIGN PATENT DOCUMENTS

| | | |
|---|---|---|
| JP | 7-186451 | 7/1995 |
| JP | 2006-205689 | 8/2006 |
| JP | 2007-90693 | 4/2007 |
| JP | 2007-237446 | 9/2007 |

* cited by examiner

*Primary Examiner* — Lamson D Nguyen
(74) *Attorney, Agent, or Firm* — Cooper & Dunham LLP

(57) ABSTRACT

An image forming apparatus includes at least one recording head module including a plurality of heads, a branch member, and a base member. Each of the heads includes a plurality of nozzle arrays, and discharges liquid droplets onto a sheet. The branch member is provided on the heads to extend in a direction in which the heads are arranged, and forms a common channel for distributing and supplying liquid to the heads. The base member has an L-shaped cross section along a direction perpendicular to the direction in which the heads are arranged, and has a first surface for holding the heads arranged thereon in an array and a second surface. An end portion of the first surface not connected to the second surface does not project more than a corresponding end portion of at least one of the heads and the branch member.

10 Claims, 9 Drawing Sheets

IMAGE FORMING APPARATUS

TECHNICAL FIELD

The present invention relates to an image forming apparatus, and more particularly, to an image forming apparatus including a recording head that discharges liquid droplets.

BACKGROUND ART

Image forming apparatuses include, for example, a printer, a facsimile machine, a copier, a plotter, and a multifunctional machine combining several of the functions of these apparatuses. As an image forming apparatus using a liquid discharge recording method that uses a recording head that discharges ink liquid droplets, for example, an inkjet recording apparatus is known.

Image forming apparatuses using the liquid discharge recording method perform image formation (hereinafter used as a synonym for recording, imaging, and printing) by discharging the ink droplets from the recording head onto a sheet being conveyed. Herein, such sheet is not limited to paper but includes any material to which the ink droplets and other liquids can adhere, such as an OHP (overhead projector) sheet, and is referred to also as a recorded medium, a recording medium, recording paper, a recording sheet, and so forth.

Image forming apparatuses using the liquid discharge recording method can be divided into serial-type image forming apparatuses, which form an image by discharging liquid droplets from a recording head that moves in a main scanning direction, and line-type image forming apparatuses, which form an image by using a line-type recording head that discharges liquid droplets while the head remains stationary.

As an example of the image forming apparatus as described above, a line-type image forming apparatus is known, as described above, which includes a line-type recording head including nozzle arrays arranged to cover the full width of the sheet being conveyed. The line-type recording head used in this case includes, for example, a plurality of short heads that themselves include arrays of nozzles for discharging liquid droplets, and which are arranged in the nozzle arrangement direction. This type of recording head is referred to as a multiple array head.

In the multiple array head as described above, ink is supplied to the plurality of heads. For example, there is a background apparatus that includes at least one head module group formed by a plurality of head modules each including a multiple array head and arranged in a direction substantially perpendicular to the sheet conveyance direction, and which has an ink channel for supplying ink to the head modules.

There is another background apparatus configured such that a common ink channel for supplying ink to the respective heads is provided between two groups of head modules arranged in a staggered manner.

Further, for easier replacement of the line-type recording head, still another background apparatus is configured to include an attachment member for attaching a head retaining member, which retains a recording module including at least a line head formed by a plurality of recording heads or by a single long recording head, such that the head retaining member can move in the sheet width direction perpendicular to the sheet conveyance direction from a storage position at which image recording is performed to a non-storage position at which image recording is not performed.

As described above, to form a line head by using a head module formed by a multiple array head in which a plurality of heads are arranged, it is common to form one head module by arranging the plurality of heads in two staggered arrays to discharge one line of liquid droplets of the same color.

Further, to form a color image, four head modules for discharging liquid droplets of respective colors of Y (yellow), M (magenta), C (cyan), and K (black), for example, may be arranged in the sheet conveyance direction, or heads corresponding to four colors may be arranged on a base member to form one head module.

In any of the configurations described above, there are at least two arrays of heads (i.e., head arrays) for discharging the liquid droplets of the same color in the sheet conveyance direction. Further, to improve the accuracy of the landing position of liquid droplets of any given color, and to improve the accuracy of the landing position of liquid droplets of different colors, it is desired to make the overall distance in the sheet conveyance direction as short as possible. For example, in a configuration including four head modules arranged in the sheet conveyance direction and each including two staggered head arrays to discharge one line of liquid droplets of one color, it is desired to reduce the intervals between the head modules.

In this case, if eight head arrays for four colors are arranged on a plate-like base member as described above, the base member of the simple plate shape needs to have openings through which ink droplets are discharged from the heads onto a sheet. Due to the limited strength of the base member, therefore, there is a limitation in reducing the intervals between the head arrays. Accordingly, it is difficult to reduce the size of the entire recording head.

Further, in the background line head, the ink supply channel and a board for transmitting signals to the heads are provided between the head arrays in the horizontal direction with respect to the heads. Therefore, it is difficult to reduce the intervals between the head arrays, and the entire line head is increased in size.

Further, in the multiple array head, it is difficult to separately replace the heads. Therefore, an easier head replacement operation is desired.

BRIEF SUMMARY

This patent specification describes an image forming apparatus. In one example, an image forming apparatus includes at least one recording head module including a plurality of heads, a branch member, and a base member. Each of the heads includes a plurality of nozzle arrays, and is configured to discharge liquid droplets onto a sheet. The branch member is provided on the heads to extend in a direction in which the heads are arranged, and is configured to form a common channel for distributing and supplying liquid to the heads. The base member is configured to have an L-shaped cross section along a direction perpendicular to the direction in which the heads are arranged, and to have a first surface for holding the heads arranged thereon in an array and a second surface. An end portion of the first surface not connected to the second surface does not project more than a corresponding end portion of at least one of the heads and the branch member.

This patent specification further describes a recording head module. In one example, a recording head module includes a plurality of heads, a branch member, and a base member. Each of the heads includes a plurality of nozzle arrays, and is configured to discharge liquid droplets onto a sheet. The branch member is provided on the heads to extend in a direction in which the heads are arranged, and is configured to form a common channel for distributing and supplying liquid to the heads. The base member is configured to have an L-shaped cross section along a direction perpendicular to the direction in which the heads are arranged, and to have a first surface for holding the heads arranged thereon in an array and a second surface. An end portion of the first surface not connected to the second surface does not project more than a corresponding end portion of at least one of the heads and the branch member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
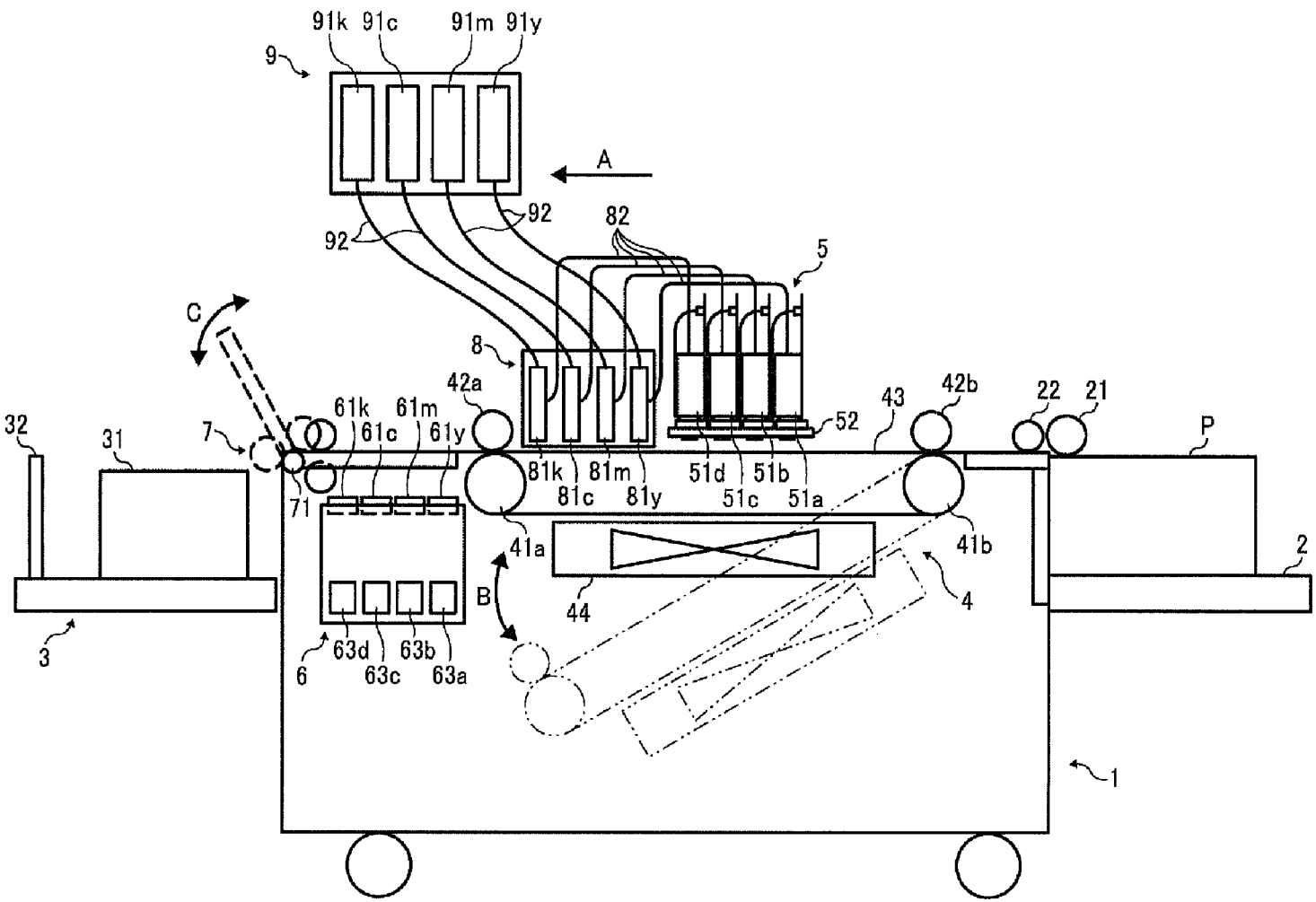
FIG. 1 is a schematic explanatory side view for explaining the overall configuration of an example of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, particularly to FIGS. 1 and 2, an example of an image forming apparatus according to an illustrative embodiment of the present invention will be described.

Figure 2:
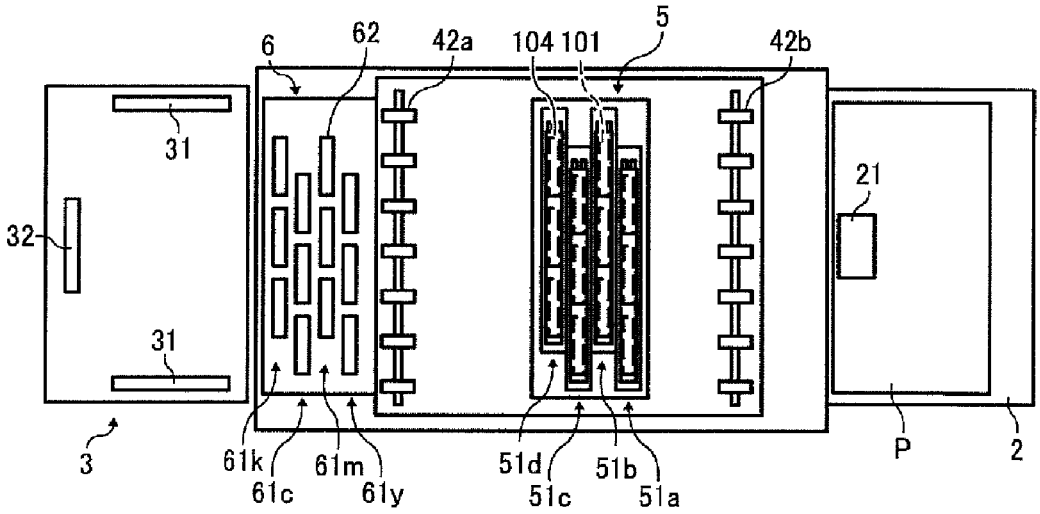
FIG. 2 is an explanatory plan view of essential parts of the image forming apparatus.

FIG. 1 is a schematic configuration view illustrating the overall configuration of the image forming apparatus. FIG. 2 is a schematic explanatory plan view of the image forming apparatus.

The image forming apparatus is a line-type image forming apparatus including an apparatus body 1, a sheet feeding tray 2, a sheet discharging tray 3, a conveying unit 4, an image forming unit 5, a cleaning unit 6, a conveying and guiding unit 7, an ink tank unit 8, and a main tank unit 9.

The sheet feeding tray 2 holds a stack of sheets P to be fed. The sheet discharging tray 3 holds the printed sheets P discharged and stacked thereon. The conveying unit 4 conveys each of the sheets P from the sheet feeding tray 2 to the sheet discharging tray 3. The image forming unit 5 includes head modules 51*a*, 51*b*, 51*c*, and 51*d* according to an embodiment of the present invention, which discharge liquid droplets onto the sheet P conveyed by the conveying unit 4 to perform a printing operation. The cleaning unit 6 serves as a maintenance and restoration mechanism for performing the maintenance and restoration of respective recording heads of the image forming unit 5 after the completion of the printing operation or at required timing. The conveying and guiding unit 7 opens and closes the cleaning unit 6. The ink tank unit 8 supplies ink to the head modules 51*a*, 51*b*, 51*c*, and 51*d* of the image forming unit 5. The main tank unit 9 supplies ink to the ink tank unit 8.

The apparatus body 1 is formed by not-illustrated front, rear, and side plates and stays. The sheets P stacked on the sheet feeding tray 2 are fed one by one to the conveying unit 4 by a separation roller 21 and a sheet feeding roller 22.

The conveying unit 4 includes a conveyance drive roller 41*a*, a conveyance driven roller 41*b*, and a circular conveying belt 43 stretched therebetween. A surface of the conveying belt 43 is formed with a plurality of not-illustrated holes. Under the conveying belt 43, a suction fan 44 is provided to suction the sheet P. Above the conveyance drive roller 41*a* and the conveyance driven roller 41*b*, conveyance guiding rollers 42*a* and 42*b* respectively held by not-illustrated guide members are brought into contact with the conveying belt 43 by the weight thereof.

The conveying belt 43 is rotationally moved along with the rotation of the conveyance drive roller 41*a* caused by a not-illustrated motor. The sheet P is auctioned onto the conveying belt 43 by the suction fan 44 and conveyed along with the rotational movement of the conveying belt 43. The conveyance driven roller 41*b* and the conveyance guiding rollers 42*a* and 42*b* are driven to rotate by the conveying belt 43.

Above the conveying unit 4, the image forming unit 5, which includes the plurality of head modules 51*a*, 51*b*, 51*c*, and 51*d* for discharging the liquid droplets onto the sheet P for the printing operation, is provided to be movable in a direction indicated by an arrow A in FIG. 1 and in a direction opposite thereto. In the maintenance and restoration operation (i.e., a cleaning operation), the image forming unit 5 is moved to a position above the cleaning unit 6. Meanwhile, in the image forming operation, the image forming unit 5 is moved back to the position illustrated in FIG. 1.

In the image forming unit 5, the head modules 51*a*, 51*b*, 51*c*, and 51*d* are arranged on a line head base member 52 in a sheet conveyance direction. In each of the head modules 51*a*, 51*b*, 51*c*, and 51*d*, a plurality of heads are arranged in an array. Each of the plurality of heads includes two nozzle arrays, in each of which a plurality of nozzles for discharging the liquid droplets are provided. In the present embodiment, the liquid droplets of the Y (yellow) color are discharged from one of two nozzle arrays of each of the head modules 51*a* and 51*b*, and the liquid droplets of the M (magenta) color are discharged from the other one of the two nozzle arrays. Further, the liquid droplets of the C (cyan) color are discharged from one of two nozzle arrays of each of the head modules 51*c* and 51*d*, and the liquid droplets of the K (black) color are discharged from the other one of the two nozzle arrays.

That is, the image forming unit 5 is configured such that each two of the head modules 51*a*, 51*b*, 51*c*, and 51*d* for discharging the liquid droplets of the same color are arranged side by side in the sheet conveyance direction to form one nozzle array extending the width of the sheet P.

Upstream of the image forming unit 5, the ink tank unit 8 is provided which includes ink tanks 81*y*, 81*m*, 81*c*, and 81*k*. The ink in the ink tanks 81*y*, 82*m*, 81*c*, and 81*k* is supplied to the respective head modules 51*a*, 51*b*, 51*c*, and 51*d* through respective supply tubes 82. Due to the water head difference between the ink tanks 81*y*, 82*m*, 81*c*, and 81*k* and the head modules 51*a*, 51*b*, 51*c*, and 51*d*, negative pressure on the respective heads of the head modules 51*a*, 51*b*, 51*c*, and 51*d* is generated.

The ink tank unit 8 is provided to be movable in the direction indicated by the arrow A together with the image forming unit 5. For convenience of illustration, the supply tubes 82 extending from the ink tanks 81*y*, 81*m*, 81*c*, and 81*k* to the head modules 51*a*, 51*b*, 51*c*, and 51*d* are illustrated in FIG. 1 as if the supply tubes 82 are connected to respective upper portions of the head modules 51*a*, 51*b*, 51*c*, and 51*d*. As described later (see FIG. 7), however, the supply tubes 82 are connected to respective end portions of the head modules 51*a*, 51*b*, 51*c*, and 51*d* in a longitudinal direction thereof, i.e., a direction perpendicular to the sheet conveyance direction.

Upstream of the ink tanks 81*y*, 81*m*, 81*c*, and 81*k*, the main tank unit 9 is provided which supplies the ink from main tanks 91*y*, 91*m*, 91*c*, and 91*k* thereof to the ink tanks 81*y*, 82*n*, 81*c*, and 81*k* through respective supply tubes 92.

Downstream of the conveying unit 4, the conveying and guiding unit 7 is provided which discharges the sheet P onto the sheet discharging tray 3. The conveying and guiding unit 7 includes a fulcrum 71 later described. The sheet P guided and conveyed by the conveying and guiding unit 7 is discharged onto the sheet discharging tray 3. The sheet discharging tray 3 includes a pair of side fences 31 for aligning the sheet P in the width direction and an end fence 32 for aligning the leading end of the sheet P.

The cleaning unit (i.e., the maintenance and restoration mechanism) 6 includes four cleaning devices 61*y*, 61*m*, 61*c*, and 61*k* corresponding to the respective head modules 51*a*, 51*b*, 51*c*, and 51*d* of the image forming unit 5. Each of the cleaning devices 61*y*, 61*m*, 61*c*, and 61*k* includes not-illustrated wiping members and cap members 62 (see FIG. 2) corresponding to the respective heads of the corresponding one of the head modules 51*a*, 51*b*, 51*c*, and 51*d*. The cap members 62 of the respective cleaning devices 61*y*, 61*m*, 61*c*, and 61*k* are configured to be vertically movable for each array. Under the cleaning devices 61*y*, 61*m*, 61*c*, and 61*k*, suction pumps 63*a*, 63*b*, 63*c*, and 63*d* are provided which suction the ink from the nozzles, with nozzle surfaces of the head modules 51*a*, 51*b*, 51*c*, and 51*d* capped with the respective cap members 62.

After the printing operation in the image forming apparatus, the cleaning devices 61*y*, 61*m*, 61*c*, and 61*k* suction the ink from the nozzles while capping the nozzle surfaces of the respective heads of the head modules 51*a*, 51*b*, 51*c*, and 51*d* for discharging the liquid droplets, or remove the ink adhering to the nozzle surfaces of the respective heads of the head modules 51*a*, 51*b*, 51*c*, and 51*d* by using the wiping members. In this case, as illustrated in FIG. 1, the entire conveying unit 4 is rotated downward in one of the directions indicated by double-headed arrow B after the completion of the printing operation, with the conveyance driven roller 41*b* acting as a fulcrum, thereby, enlarging the space between the conveying unit 4 and the image forming unit 5 so that it becomes larger than in the image forming operation, and space for the movement of the image forming unit 5 is secured. At the same time, the conveying and guiding unit 7 located above the cleaning unit 6 is rotated upward around the fulcrum 71 in one of the directions indicated by double-headed arrow C, and an upper part of the cleaning unit 6 is opened.

After the conveying unit 4 and the conveying and guiding unit 7 have been opened (i.e., released), the image forming unit 5 is moved in the sheet feeding direction (i.e., the direction indicated by the arrow A) and stopped at a position above the cleaning unit 6. Then, the cleaning unit 6 is elevated to perform the cleaning operation (i.e., the maintenance and restoration operation) on the respective head modules 51*a*, 51*b*, 51*c*, and 51*d*.

Figure 3:
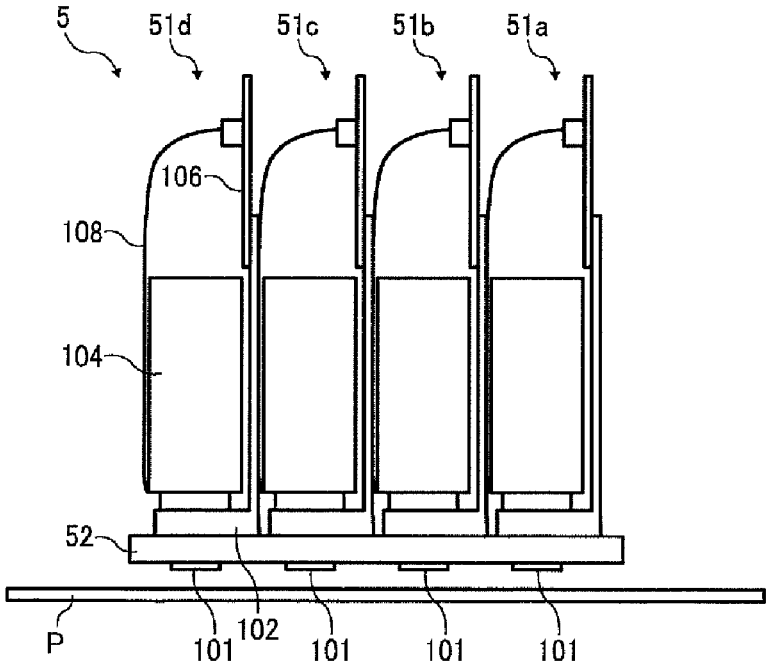
FIG. 3 is an explanatory front view of an image forming unit of the image forming apparatus.
Figure 4:
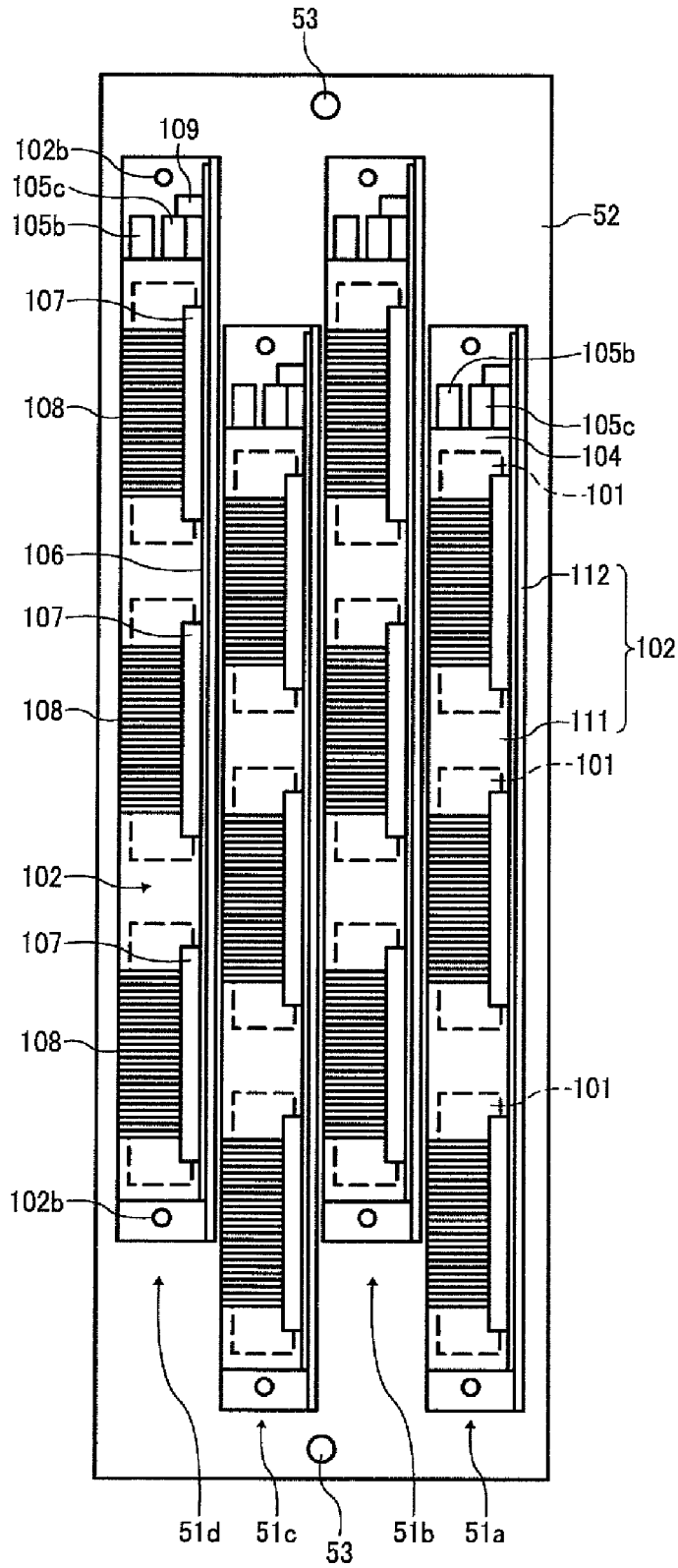
FIG. 4 is an explanatory plan view of the image forming unit.
Figure 5:
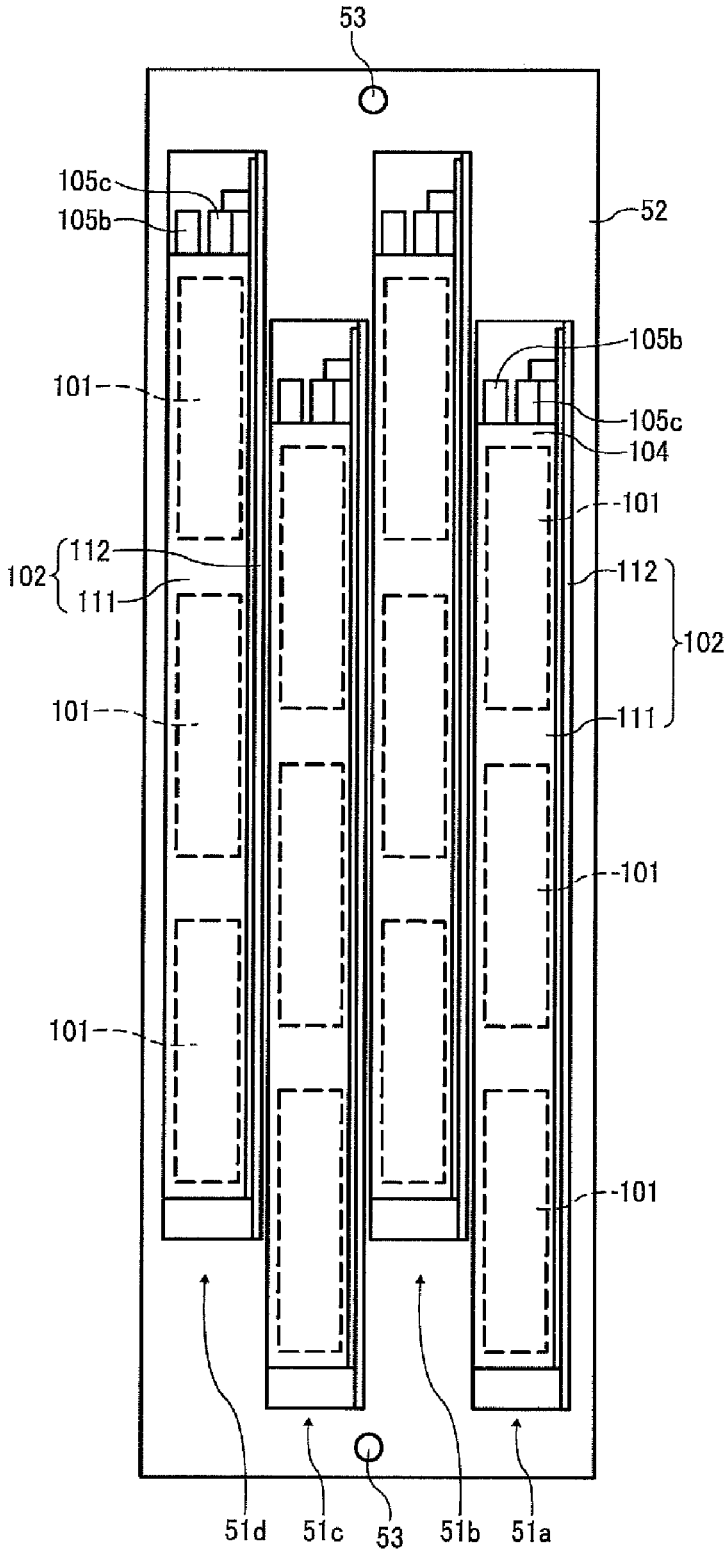
FIG. 5 is an explanatory plan view of the image forming unit, in which electrical connection boards and connection cables are omitted.
Figure 6:
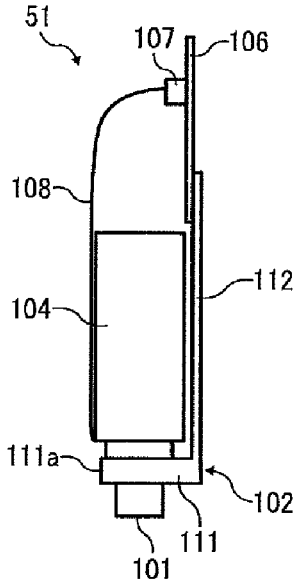
FIG. 6 is an explanatory front view of a head module.
Figure 7:
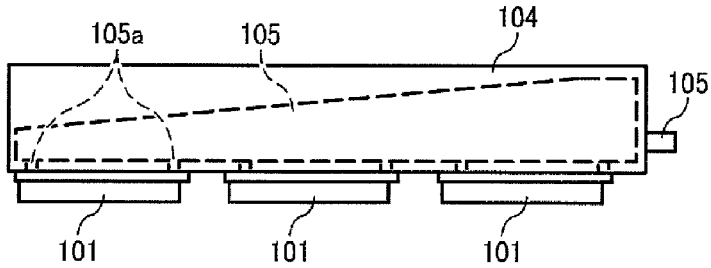
FIG. 7 is an explanatory side view of the head module.
Figure 8:
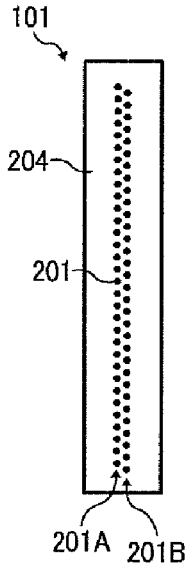
FIG. 8 is an explanatory bottom view of a head.
Figure 9A:
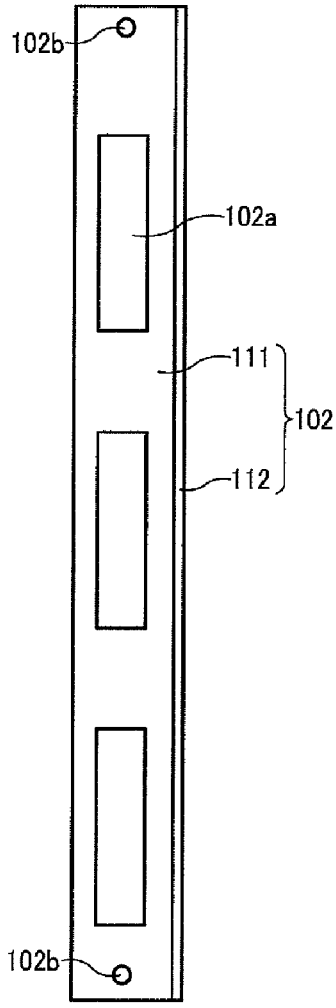
FIG. 9A is an explanatory plan view of a base member of the head module.
Figure 9B:
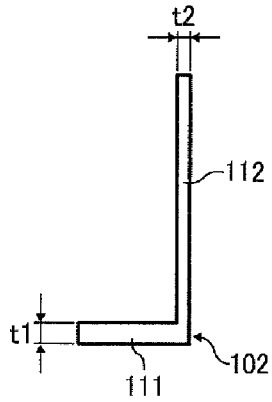
FIG. 9B is an explanatory side view of the base member of the head module.
Figure 10A:
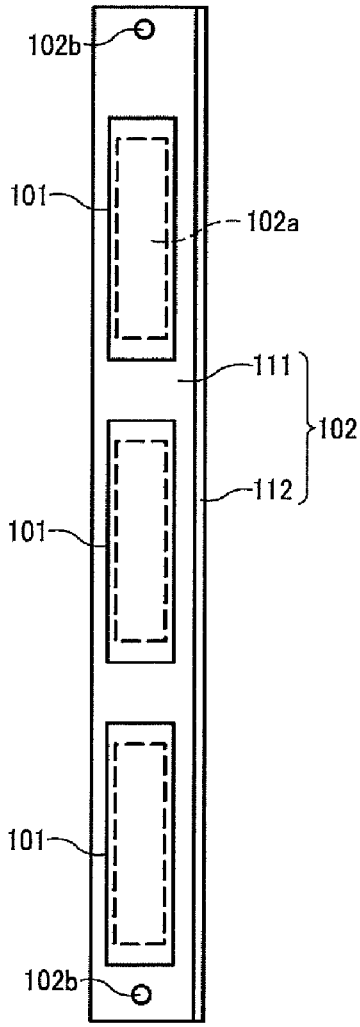
FIG. 10A is an explanatory plan view of the base member attached with heads.
Figure 10B:
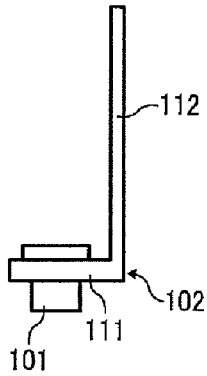
FIG. 10B is an explanatory side view of the base member attached with the heads.
Figure 11A:
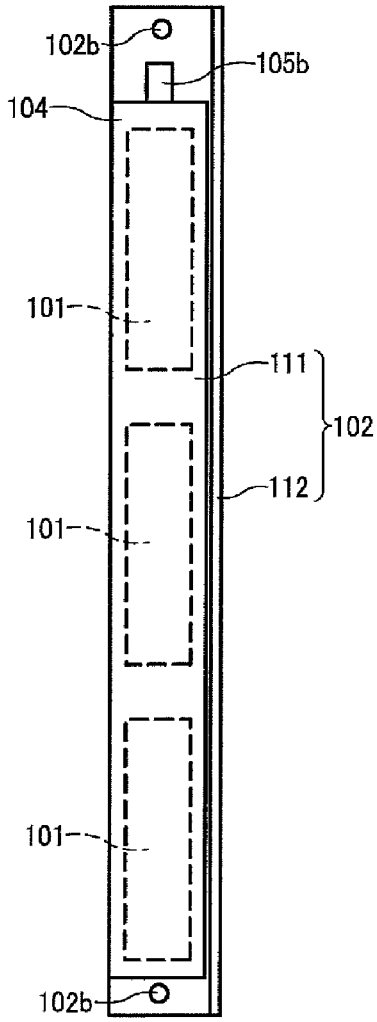
FIG. 11A is an explanatory plan view of the base member attached with a branch member on the heads.
Figure 11B:
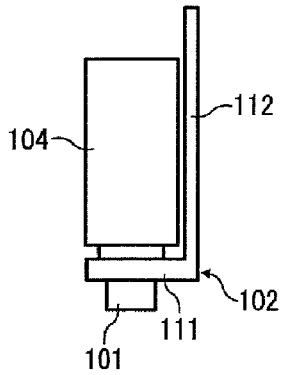
FIG. 11B is an explanatory side view of the base member attached with the branch member on the heads.

Subsequently, with reference to FIGS. 3 to 11B, detailed description will be made of the image forming unit 5 and the head modules 51*a*, 51*b*, 51*c*, and 51*d*. FIG. 3 is an explanatory front view of the image forming unit 5, and FIG. 4 is an explanatory plan view of the image forming unit 5. FIG. 5 is an explanatory plan view of the image forming unit 5, in which electrical connection boards and connection cables are omitted. FIG. 6 is an explanatory front view of one of the head modules 51*a*, 51*b*, 51*c*, and 51*d* (designated with the reference numeral 51 in the drawing). FIG. 7 is an explanatory side view of the one of the head modules 51*a*, 51*b*, 51*c*, and 51*d*. FIG. 8 is an explanatory bottom view of one of the heads of the one of the head modules 51*a*, 51*b*, 51*c*, and 51*d*. FIGS. 9A and 9B are an explanatory plan view and an explanatory side view, respectively, of a base member of the one of the head modules 51*a*, 51*b*, 51*c*, and 51*d*. FIGS. 10A and 10B are an explanatory plan view and an explanatory side view, respectively, of the base member attached with a plurality of heads. FIGS. 11A and 11B are an explanatory plan view and an explanatory side view, respectively, of the base member attached with a branch member on the plurality of heads.

As described above, the image forming unit 5 is configured to include four head modules 51*a*, 51*b*, 51*c*, and 51*d* arranged on the line head base member 52 in the sheet conveyance direction. Each of the head modules 51*a*, 51*b*, 51*c*, and 51*d* includes a plurality of heads 101 arranged in an array. The line head base member 52 is formed with positioning holes 53 for positioning the line head base member 52 with respect to the apparatus body 1.

In each of the head modules 51*a*, 51*b*, 51*c*, and 51*d*, the plurality (three in the present embodiment) of heads 101 for discharging the liquid droplets are arranged in an array on a base member 102. As illustrated in FIG. 8, each of the heads 101 includes a nozzle surface 204 including nozzle arrays 201A and 201B, in each of which a plurality of nozzles 201 for discharging the liquid droplets are arranged. The configuration of the head 101 is not limited to the above. For example, the head 101 may include three or more nozzle arrays.

The base member 102 of each of the head modules 51*a*, 51*b*, 51*c*, and 51*d* has an L-shaped cross section along a direction perpendicular to the direction in which the heads 101 are arranged (hereinafter referred to as the head arrangement direction). The base member 102 includes a first surface 111 extending in the horizontal direction and a second surface 112 extending in the vertical direction.

On the first surface 111 of the base member 102, the plurality of heads 101 are arranged. On the plurality of heads 101, a branch member (i.e., a common channel forming member) 104 is provided to extend in the head arrangement direction to form a common channel 105 which distributes and supplies ink to the plurality of heads 101. The branch member 104 and the heads 101 are connected to each other, with ink supply ports of the heads 101 directly connected to supply ports 105*a* of the branch member 104. To supply the ink of different colors to the nozzle arrays 201A and 201B of each of the heads 101, the interior of the common channel 105 is divided into two sub-channels by a not-illustrated separation wall extending in the longitudinal direction of the branch member 104. To supply the ink of different colors to the two sub-channels of the common channel 105, the branch member 104 is provided with ink supply ports 105*b* and 105*c* (see FIGS. 4 and 5) at an end portion thereof in the head arrangement direction to receive the ink supplied from the corresponding ones of the ink tanks 81*y*, 81*m*, 81*c*, and 81*k*.

Further, the first surface 111 of the base member 102 includes an end portion 111*a* (see FIG. 6) not connected to the second surface 112. The first surface 111 is formed such that the end portion 111*a* does not project more than a leading end portion of the branch member 104 in the sheet conveyance direction, i.e., that the width in the sheet conveyance direction of the first surface 111 does not exceed the width in the sheet conveyance direction of the branch member 104. Therefore, the width in the sheet conveyance direction of each of the head modules 51*a*, 51*b*, 51*c*, and 51*d* can be set to be the sum of the width (i.e., the thickness) of the branch member 104 and the width (i.e., the thickness) of the second surface 112 of the base member 102. Accordingly, the width in the sheet conveyance direction of each of the head modules 51*a*, 51*b*, 51*c*, and 51*d* can be reduced.

As illustrated in FIG. 9A, the first surface 111 of the base member 102 is formed with openings 102*a* for discharging the liquid droplets from the heads 101 onto the sheet P. The heads 101 are fit in the openings 102*a*. Further, the opposite ends of the first surface 111 of the base member 102 are formed with reference holes 102*b* for attaching the corresponding one of the head modules 51*a*, 51*b*, 51*c*, and 51*d* to the line head base member 52.

As illustrated in FIG. 9B, in the base member 102, the relationship between the thickness t1 of the first surface 111 and the thickness t2 of the second surface 112 is represented as t1>t2. That is, the first surface 111 attached with the heads 101 needs to have adequate strength, and thus is formed to be relatively thick. Meanwhile, the second surface 112 is formed to be relatively thin to improve the accuracy of the landing position of the liquid droplets by making the intervals between the head modules 51*a*, 51*b*, 51*c*, and 51*d* arranged in the sheet conveyance direction as short as possible.

As illustrated in FIG. 6, an upper portion of the second surface 112 of the base member 102 on the side of the first surface 111 is attached with a relay board (i.e., an electrical connection board) 106 for transmitting an electrical signal to the head 101. The relay board 106 and the head 101 are connected to each other by a flexible printed board (i.e., a wiring board) 108 which extends from a connector 107 provided to the relay board 106, passes over the upper surface of the branch member 104 and along a side surface of the branch member 104, and leads to the head 101. Further, as illustrated in FIG. 4, an end portion of the second surface 112 of the base member 102 (i.e., an end portion of the second surface 112 on the side of the ink supply ports 105*b* and 105*c* of the branch member 104) is attached with a connector 109 for connecting the relay board 106 to a not-illustrated control board mounted with a control unit provided to the apparatus body 1.

In this case, it is preferable to form the base member 102 by using a relatively high thermal conductivity material, and to use the base member 102 as a heat sink (i.e., a heat radiating member) which radiates the heat generated by the heads 101 and electrical connection boards including the relay board 106 and another board mounted with an electrical component.

The head modules 51*a*, 51*b*, 51*c*, and 51*d* configured as described above are arranged on the line head base member 52 in the sheet conveyance direction such that the respective base members 102 of the head modules 51*a*, 51*b*, 51*c*, and 51*d* face the same direction, i.e., that the positional relationship between the second surface 112 of the base member 102 and the heads 101 is the same among the plurality of head modules 51*a*, 51*b*, 51*c*, and 51*d*. With this configuration, it is possible to equalize the shape of the base member 102 and the head installation positions (i.e., the openings 102*a*) among the plurality of head modules 51*a*, 51*b*, 51*c*, and 51*d*.

As described above, the present embodiment includes the head modules 51*a*, 51*b*, 51*c*, and 51*d*, each of which includes the plurality of heads 101 for discharging the liquid droplets arranged in an array on the base member 102. Further, the base member 102 of each of the head modules 51*a*, 51*b*, 51*c*, and 51*d* has an L-shaped cross section along a direction perpendicular to the head arrangement direction. The base member 102 includes the first surface 111 extending in the horizontal direction and holding the plurality of heads 101 arranged thereon. On the plurality of heads 101, the branch member 104 is provided to extend in the head arrangement direction to form the common channel 105 which distributes and supplies liquid to the plurality of heads 101. The base member 102 also includes the second surface 112 extending in a direction perpendicular to the first surface 111. An end portion of the first surface 111 of the base member 102 not connected to the second surface 112 does not project more than a corresponding end portion of at least one of the plurality of heads 101 and the branch member 104. Thus, each of the head modules 51*a*, 51*b*, 51*c*, and 51*d* forming a multiple array head is reduced in width in the sheet conveyance direction. In the arrangement of the plurality of head modules 51*a*, 51*b*, 51*c*, and 51*d*, therefore, the intervals between the head arrays are reduced, and the accuracy of the landing position of the liquid droplets is improved. Further, the heads 101 are formed into modules. Therefore, the replacement of the heads 101 can be performed relatively easily.

Further, the base member 102 is formed into the L-shape and thus has adequate strength, even if the base member 102 is provided with the openings 102*a* for discharging the liquid droplets from the heads 101. Therefore, even if the width in the sheet conveyance direction of each of the head modules 51*a*, 51*b*, 51*c*, and 51*d* is reduced, the base member 102 does not suffer from insufficient strength. Further, the branch member (i.e., the common channel forming member) 104 forming the common channel 105 for supplying ink to the plurality of heads 101 is provided on the heads 101. Therefore, the width in the sheet conveyance direction of each of the head modules 51*a*, 51*b*, 51*c*, and 51*d* can be set to be the width in the sheet conveyance direction of the branch member 104 or the heads 101. Accordingly, the width in the sheet conveyance direction of each of the head modules 51*a*, 51*b*, 51*c*, and 51*d* can be reduced. Further, a plurality (i.e., two in the present embodiment) of head arrays for discharging the liquid droplets of the same color are provided in separate ones (i.e., two in the present embodiment) of the head modules 51*a*, 51*b*, 51*c*, and 51*d*. Therefore, the openings 102*a* for the heads 101 formed in the individual base member 102 are reduced by half. Also in this point, the strength of the base member 102 can be ensured.

Figure 12:
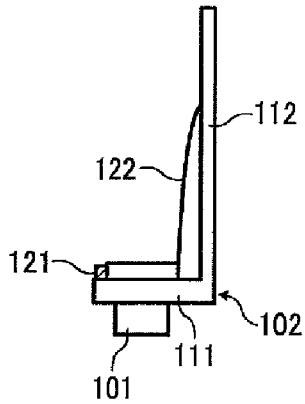
FIG. 12 is a schematic explanatory front view of a head module according to another embodiment of the present invention, in which components such as a branch member are omitted.

With reference to FIG. 12, another embodiment of the present invention will now be described. FIG. 12 is a schematic explanatory front view of a head module according to the another embodiment, in which components such as a branch member are omitted.

In the present embodiment, an end portion of the first surface 111 of the base member 102 not connected to the second surface 112 is provided with a positioning member 121 for regulating the position of the heads 101. With this configuration, the positioning of the heads 101 can be performed relatively easily. Further, between the second surface 112 of the base member 102 and the heads 101, a resilient member (e.g., a spring) 122 is provided to bias the heads 101 toward the positioning member 121. With this configuration, the positioning of the heads 101 can be performed further easily, and the positional alignment of the plurality of heads 101 can be performed relatively easily.

Figure 13:
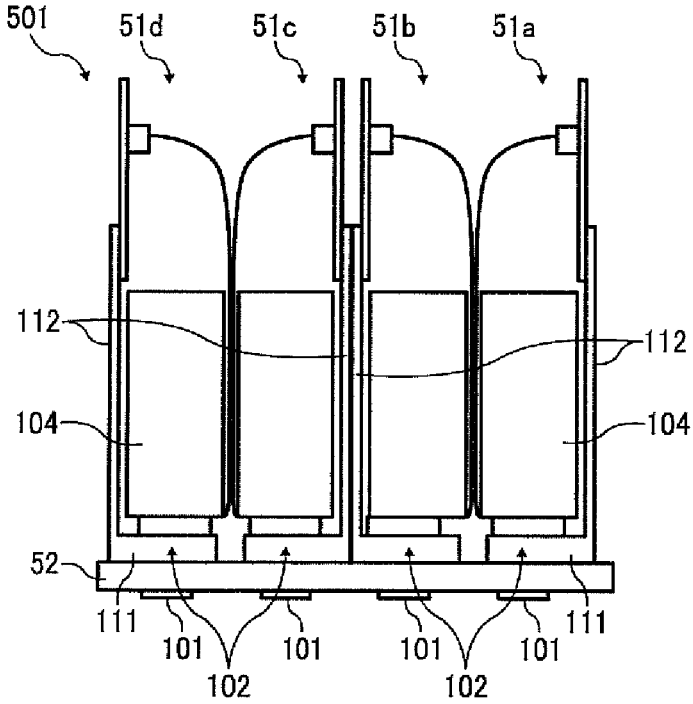
FIG. 13 is a schematic explanatory front view of an image forming unit according to still another embodiment of the present invention.

With reference to FIG. 13, still another embodiment of the present invention will now be described. FIG. 13 is a schematic explanatory front view of an image forming unit 501 according to the still another embodiment.

In the present embodiment, the plurality of head modules 51*a*, 51*b*, 51*c*, and 51*d* are arranged on the line head base member 52 in the sheet conveyance direction such that the base members 102 of the head modules 51*a*, 51*b*, 51*c*, and 51*d* alternately face opposite directions, i.e., that the second surfaces 112 of each adjacent two of the base members 102 stand back to back. With this configuration, it is possible to further reduce the interval between the plurality of head arrays arranged adjacent to each other to discharge the liquid droplets of the same color. Accordingly, the accuracy of the landing position of the liquid droplets can be improved.

In the embodiments described above, description has been made of the example which includes four head modules 51*a*, 51*b*, 51*c*, and 51*d*, and in which different colors are assigned to and discharged from two nozzle arrays 201A and 201B of each two of the head modules 51*a*, 51*b*, 51*c*, and 51*d*. Alternatively, if eight head modules are provided, and if each two of the eight head modules discharge the liquid droplets of one color, the resolution can be improved twice as much.

Further, in the embodiments described above, description has been made of the example in which the width in the sheet conveyance direction of the heads 101 is less than the width in the sheet conveyance direction of the branch member 104, and in which the end portion 111*a* of the first surface 111 of the base member 102 not connected to the second surface 112 does not project more than the corresponding end portion of the branch member 104. However, if the width in the sheet conveyance direction of the heads 101 is greater than the width in the sheet conveyance direction of the branch member 104, the configuration may be modified such that the end portion 111*a* of the first surface 111 of the base member 102 not connected to the second surface 112 does not project more than the corresponding end portion of the heads 101. That is, it is preferable that the end portion 111*a* of the first surface 111 of the base member 102 not connected to the second surface 112 does not project more than the respective corresponding end portions of the heads 101 and the branch member 104.

In the present patent application, the term "image forming apparatus" refers to an apparatus which performs image formation by discharging liquid onto a medium such as paper, thread, fiber, cloth, leather, metal, plastic, glass, wood, and ceramics. Further, the term "image formation" refers not only to providing a medium with a meaningful image such as a letter and a figure, but also to providing a medium with a meaningless image such as a pattern, i.e., an operation of simply making liquid droplets land on a medium. Further, the term "ink" is not limited to what is generally called ink, but is used as a general term for all kinds of liquids usable in the image formation, such as so-called recording liquid, fixing process liquid, and liquid. For example, a DNA (deoxyribonucleic acid) sample, a resist, and a pattern material are included in the link.

Numerous additional modifications and variations are possible in light of the above teachings. It is therefore to be understood that, within the scope of the appended claims, the disclosure of this patent specification may be practiced otherwise than as specifically described herein.

This patent specification is based on Japanese Patent Application No. 2008-054062 filed on Mar. 5, 2008 in the Japanese Patent Office, the entire contents of which are incorporated by reference herein.

What is claimed is:

1. An image forming apparatus comprising at least one recording head module, the at least recording head module comprising:

a plurality of heads each including a plurality of nozzle arrays to discharge liquid droplets onto a sheet;

a branch member provided on the heads to extend in a direction in which the heads are arranged to form a common channel for distributing and supplying liquid to the heads; and a base member having an L-shaped cross section in a direction perpendicular to the direction in which the heads are arranged and to have a first surface for holding the heads arranged thereon in an array and a second surface, an end portion of the first surface not connected to the second surface not projecting more than a corresponding end portion of at least one of the heads and the branch member.

2. The image forming apparatus as described in claim 1, further comprising:

a positioning member provided to the end portion of the first surface not connected to the second surface to regulate the position of the heads.

3. The image forming apparatus as described in claim 2, further comprising:

a resilient member provided between the second surface and the heads to bias the heads toward the positioning member.

4. The image forming apparatus as described in claim 1, wherein the second surface is thinner than the first surface.

5. The image forming apparatus as described in claim 1, further comprising:

an electrical connection board provided above the branch member to supply an electrical signal to the heads.

6. The image forming apparatus as described in claim 5, wherein the base member functions as a heat radiating member to radiate the heat generated by the electrical connection board.

7. The image forming apparatus as described in claim 1, wherein two recording head modules to discharge liquid droplets of the same color are arranged in a sheet conveyance direction such that the nozzle arrays of the two recording head modules cover a sheet width.

8. The image forming apparatus as described in claim 1, wherein a plurality of recording head modules is arranged in a sheet conveyance direction and the respective base members of the plurality of recording head modules face the same direction.

9. The image forming apparatus as described in claim 1, wherein a plurality of recording head modules is arranged in a sheet conveyance direction and the respective base members of the plurality of recording head modules alternately face opposite directions.

10. A recording head module comprising:

a plurality of heads each including a plurality of nozzle arrays to discharge liquid droplets onto a sheet;

a branch member provided on the heads to extend in a direction in which the heads are arranged and to form a common channel for distributing and supplying liquid to the heads; and a base member having an L-shaped cross section along a direction perpendicular to the direction in which the heads are arranged, the base member having a first surface for holding the heads arranged thereon in an array and a second surface, an end portion of the first surface not connected to the second surface not projecting more than a corresponding end portion of at least one of the heads and the branch member.

* * * * *